United States Patent [19]

Sharma

[11] 4,453,639

[45] Jun. 12, 1984

[54] RACK OR HOLDER FOR TEST TUBES

[76] Inventor: Yash Sharma, 2766 January Cts., Falls Church, Va. 22043

[21] Appl. No.: 377,441

[22] Filed: May 12, 1982

Related U.S. Application Data

[63] Continuation of Ser. No. 155,006, May 30, 1980, abandoned.

[51] Int. Cl.[3] ..... A47F 7/28

[52] U.S. Cl. ..... 211/74; 422/104

[58] Field of Search ..... 211/74.60 B, 69, 60 A, 211/72; 422/104; 206/369, 379, 562

[56] References Cited

U.S. PATENT DOCUMENTS

| | | | |
|---|---|---|---|
| 1,049,654 | 1/1913 | Bloom | 312/224 X |
| 1,188,146 | 6/1916 | Bagley | 211/74 |
| 1,965,032 | 7/1934 | Davey | 211/69 |
| 3,074,539 | 1/1963 | Rogovin | 206/379 |
| 3,300,055 | 1/1967 | Rohr | 211/74 |
| 3,688,916 | 9/1972 | Speelvogel et al. | 211/128 X |

*Primary Examiner*—Ramon S. Britts
*Assistant Examiner*—Robert W. Gibson, Jr.
*Attorney, Agent, or Firm*—Bacon & Thomas

[57] ABSTRACT

A test tube rack is disclosed which comprises a support plate for supporting the rear portions of the bottoms of the test tubes which support plate is inclined at an upward angle of 10° to 35° away from horizontal in the direction from front to rear and spaced apart above said support plate holding means, e.g. a pair of spaced apart parallel aperture plates for holding the test tubes in upright position. Vertical means, e.g. parallel sidewalls for supporting the holding means and the support plate in spaced apart relationship to each other are attached to the holding means. The support plate is releasably connected to the vertical means by connecting means such as a pair of parallel guide rails attached to the vertical means at an appropriate angle. Preferably, the support plate has a reflecting upper surface by means of which the bottoms of the test tubes are made visible without removing the tubes from the rack. Due to the upward inclination of the support plate, the rear rows of test tubes are elevated relative to the front rows and improved accessability of all tubes in the rack is achieved.

9 Claims, 4 Drawing Figures

Fig. 1
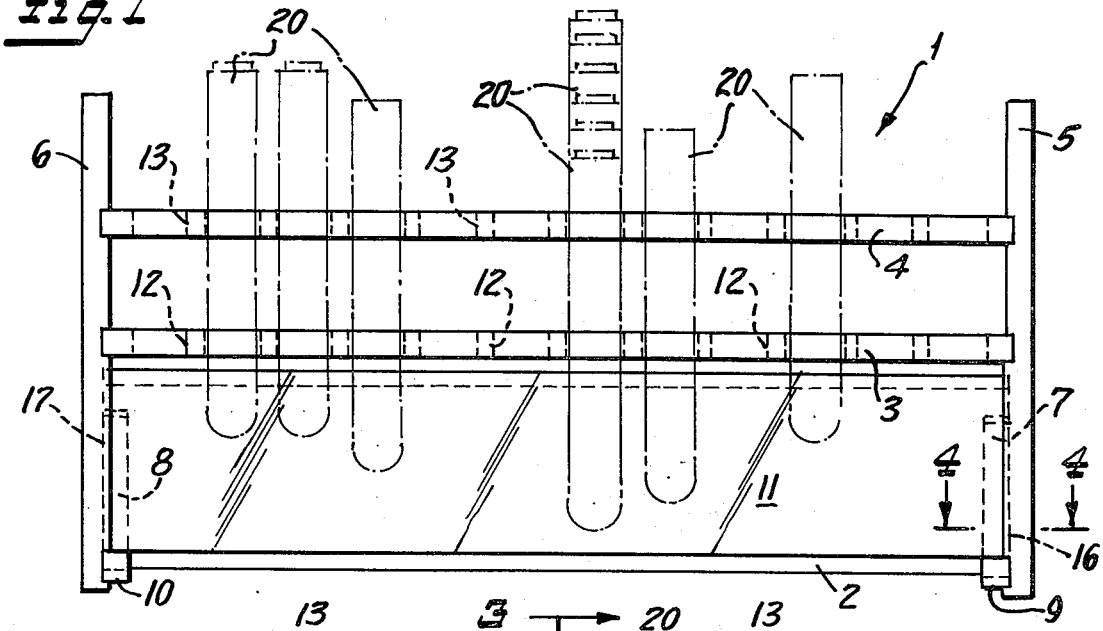
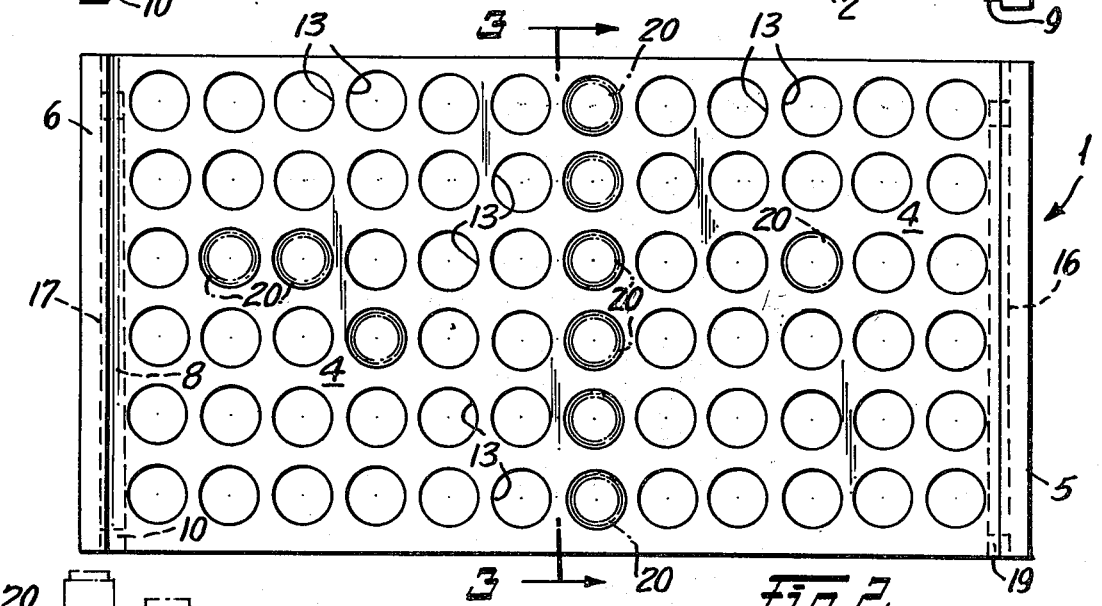
Fig. 2
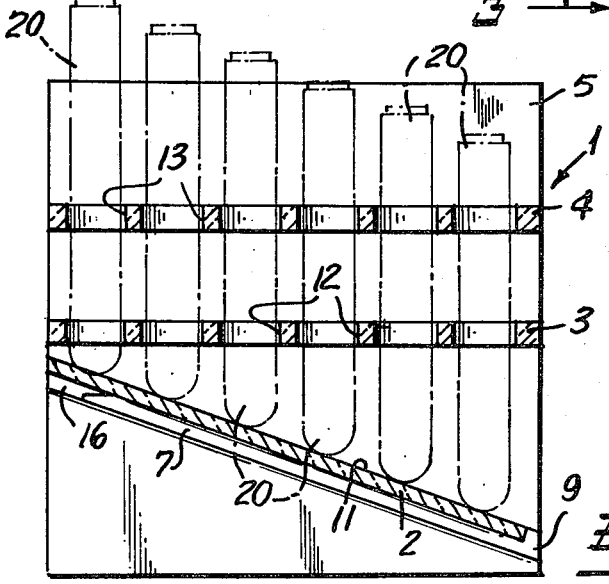
Fig. 3
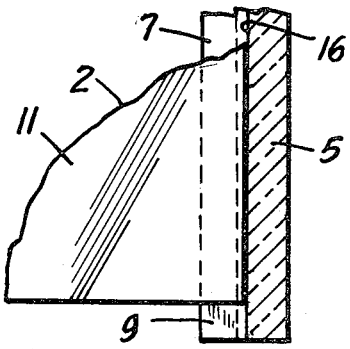
Fig. 4

RACK OR HOLDER FOR TEST TUBES

This application is a continuation, of application Ser. No. 155,006, filed 5/30/80, now abandoned.

The present invention pertains to a test tube rack for holding a plurality of test tubes.

BACKGROUND OF THE INVENTION

Conventional test tube racks typically consist of a horizontal support plate for supporting the bottom of the test tubes and spaced apart above the support plate one or two horizontal apertured plates for receiving the test tubes and holding them in upright position which plates are secured to upright sidewalls. Such a test tube rack is disclosed, e.g. in U.S. Pat. No. 1,188,146. Another less common type of holder, for test tubes or similar elongated receptacles is in the form of wire baskets wherein the horizontal plates and sidewalls are replaced by a welded wire structure. Different materials including wood, steel, aluminum and plastic have been used in the manufacture of test tube racks. Yet the basic shape has remained the same, including a horizontal support on which the test tubes are deposited at the same level.

These test tube racks have various disadvantages which are particularly troublesome in the case of test tube racks for holding a larger number of test tubes, e.g. up to 72 tubes, arranged in several, e.g. up to 6, rows, as are used in large hospital and research laboratories for carrying out a series of analytical tests.

Thus, accurately and speedy pipetting into the tubes in rear rows is difficult without removing the tubes from the rack. This is particulary the case where small amounts have to be pipetted into the tubes at the bottom, e.g. by means of micropipettors with tips. Removing a test tube from a plurality of test tubes standing upright next to each other only relatively narrowly spaced apart is time consuming and not very convenient.

Also, when one or more reagents are to be pipetted into each of a larger number of test tubes deposited in a conventional test tube rack, one does not become readily aware when a tube has inadvertently been left out because it is difficult to see whether indeed all tubes have received the respective reagents without carefully checking each tube, e.g. by removing same from the rack.

SUMMARY OF THE INVENTION

It is an object of the present invention to provide a rack for holding test tubes or similar elongated receptacles which remedies and overcomes the shortcomings and inconveniences of prior art test tube racks.

In particular, it is an object of the present invention to provide a test tube rack from which individual test tubes can be picked up more conveniently, and wherein accurate pipetting of even small amounts of reagents into all of the test tubes including those standing in the rear rows is facilitated, and each tube is sufficiently visible for a ready checking of the contents of the tubes without removing same from the rack.

In order to accomplish the foregoing objects, there is provided according to the present invention a rack for holding elongated receptacles such as test tubes comprising (a) a support plate for supporting a plurality of elongated receptacles at the rear portion of their bottoms which support plate is inclined upwardly away from the horizontal in the direction from front to rear at an angle of from about 10° to about 35° C.

(b) holding means above said support plate for maintaining each of said receptacles in upright position at a predetermined spaced relationship to each other (c) vertical means attached to said holding means for supporting said holding means and said support plate in a predetermined spaced relationship to each other, and (d) means for connecting said support plate to said vertical means.

Due to the inclination of the support plate, test tubes in rear rows stand at a higher level than those in front rows of the rack. Suitably, the holding means comprises an aperture plate having a plurality of spaced apart individual apertures for receiving each an individual test tube. Preferably, the holding means comprises a pair of parallel spaced apart aperture plates whereby the apertures in the lower and the upper aperture plate are aligned such that the test tube which is passed through these apertures is held in upright position.

Preferably, the upper surface of the support plate is a reflecting surface by means of which the bottoms of the test tubes are made visible.

DESCRIPTION OF THE DRAWINGS

FIG. 1 is a front elevational view of the test tube rack of the present invention with some of the test tubes, in phantom lines, assembled therein for purposes of illustration;

FIG. 2 is a plane view of the rack of FIG. 1;

FIG. 3 is a transverse cross-sectional view, taken on the line 3—3 of FIG. 2; and FIG. 4 is an enlarged fragmentary horizontal sectional view, taken on the line 4—4 of FIG. 1.

DETAILED DESCRIPTION OF THE INVENTION AND ITS PREFERRED EMBODIMENTS

Referring now to the figures of drawing, there is shown a preferred embodiment of a test tube rack 1 holding a plurality of test tubes 20. FIG. 1 shows an elevated front view, FIG. 2 a plane view and FIG. 3 a transverse cross-sectional view of the test tube rack 1. The rack 1 comprises an inclined rectangular shaped support plate 2 for supporting the test tubes and mounted above and spaced apart from the support plate 2 a pair of spaced apart rectangular shaped, horizontal aperture plates 3 and 4 which serve as the holding means for maintaining the test tubes 20 in upright position. The support plate 2 is inclined away from horizontal in the direction from front to rear at an angle of about 25°. The aperture plates 3 and 4 are substantially parallel to each other and are held in spacial and parallel relationship by way of a pair of parallel vertically disposed sidewalls 5 and 6 which serve as the vertical means for supporting the aperture plates 3 and 4 and the support plate 2. The support plate 2 is removably connected to the sidewalls by means of a pair of parallel guide rails 7 and 8, each of which is attached to the inner surface of one of the sidewalls 5 and 6 and is positioned in an elongated shallow groove 16 and 17 along said inner surface at an upward angle of about 25° away from horizontal in the direction from front to rear. The support plate 2 is slidably positioned on the guide rails 7 and 8. It can be manually slid onto the guide rails from the rear of the test tube rack 1. The guide rails 7 and 8 are provided with upward projections 9 and 10 at their front end for preventing the support plate 2 from sliding downwardly out of the rack 1. The support plate 2 has a reflecting upper surface 11 which reflects the bottom portion of the test tubes 20.

The test tube rack 1 shown in the drawings holds 72 test tubes 20. The overall size of a rack for holding 10–15 mm diameter tubes as are used in clinical tests suitably is as follows: 8 ½" W×4⅜" H×4⅜" D. Since the support plate 2 is inclined at an upward angle away from horizontal in the direction from front to rear, the rows of test tubes 20 in the rack 1 are sequentially elevated from front to rear exposing each row at different heights. This provides for a clear view of each tube 20 including the tubes in the rear rows, and easy accessibility to each tube during pipetting, and reduces the danger of splashing and cross-contamination during shaking of the rack 1.

The combination of the support plate 2 being inclined at an upward angle away from horizontal in the direction from front to rear and having a reflecting surface provides for good visibility of the bottoms of all test tubes. This permits easy checking whether indeed all tubes have been filled, and facilitates the observation of reactions in the test tubes, e.g. observation of formation of a precipitate at the bottom of the tubes.

The advantages of the test tube rack according to the present invention are particularly important in test tube racks which are designed to hold a large number of test tubes positioned in a plurality of parallel rows, e.g. the test tube rack holding 6 rows of 12 tubes each shown in the drawings which is particularly useful in clinical laboratories for serological tests, radioimmunological tests, blood banking and the like. However, it is readily apparent that the same advantages can be achieved according to the present invention in test tube racks which are designed to hold only a smaller number of test tubes. Accordingly, test tube racks for holding from 2 to up to about a hundred of test tubes are within the scope of the present invention.

The aperture plates 3 and 4 and sidewalls 5 and 6 are preferably made of a transparent plastic material in order to provide optimum visibility of all test tubes in the rack. Suitably a rigid autoclavable, scratch-resistant transparent plastic material such as acrylic plastic polyethylene or polypropylene is used.

Where primarily improved accessibility of the test tubes is desired yet visibility of the entire test tubes is of less importance, any other material which is conventionally used for the manufacture of test tube racks can be used including wood, stainless steel, aluminum and non-transparent plastic, or the rack may be constructed partially of transparent plastic and partially of another appropriate material or combination materials.

The preferably transparent aperture plates 3 and 4 and sidewalls 5 and 6 may be colored in any appropriate color or color-combination, e.g. for the purpose of distinguishing a rack, or a portion of a rack holding a particular type of test tubes or culture tubes from other racks or portions of racks. Furthermore, each row of apertures may be numbered and lettered for easy tube identification.

The diverse elements of aperture plates, sidewalls and guide rails are cemented together at their touching or engaged surfaces by way of any appropriate cement or solvent for the particular type of plastic material used. The diverse elements of the rack can be molded partially or as a whole rather than being assembled of united single elements.

Each of the parallel aperture plates 3 and 4 has an array of apertures 12 and 13 respectively disposed, for example, in regular rows, each row having the same number of apertures. Each aperture of the lower aperture plate 3 is vertically aligned with the corresponding aperture in the upper aperture plate 4 to ensure upright position of the test tubes 20 or elongated receptacles passed through a pair of aligned apertures.

The sidewalls 5 and 6 preferably project above the upper aperture plate 4 as shown in FIGS. 1 and 2 such as to provide protection for the test tubes 20 in the rack 1 and to form a pair of parallel handles 14 and 15. If desired, the handles may be provided with an opening (not shown) convenient for passing therethrough fingers of a hand or alternatively for supporting the rack 1 by means of a hanger or the like.

Whereas in the drawing, the holding means for maintaining the test tubes in upright position is shown as a pair of aligned spaced apart horizontal aperture plates it is also within the scope of the present invention that the holding means may be in any other form suitable for maintaining the test tubes in upright position. For example, the holding means may be comprised of a single aperture plate of sufficient thickness or of a plurality of more than two aligned parallel spaced apart aperture plates. These aperture plate(s) may be in horizontal position or inclined at a suitable angle away from the horizontal in the direction from front to rear, e.g. parallel to the support plate 2. Holding means other than aperture plates are also possible, e.g. one or several layers of a wire web of appropriate mesh size or specific wire holders for each of the tubes or elongated receptacles.

Whereas in the drawings the vertical means for supporting the holding means, e.g. the aperture plates, is shown as a pair of parallel sidewalls, it is also within the scope of the present invention that the vertical means for supporting the holding means and the support plate 2 may be in any other form suitable for fulfilling this support function, e.g. vertical elongated support members such as rods positioned in the four corners of the rack or a wire basket of appropriate shape.

Whereas in the drawing the means for connecting the support plate 2 to the vertical supporting means, e.g. the sidewalls 5 and 6, is shown as a combination of a pair of parallel guide rails 7 and 8 and a pair of elongated grooves 16 and 17, it is also within the scope of the present invention that the connecting means may be in any other form for connecting the support plate 2 to the vertical sidewalls in the required inclined position. For example, the connecting means may comprise only a pair of parallel slits or elongated grooves positioned at an appropriate angle on the inner side of each of the sidewalls adapted to receive the side edges of the support plate 2. A pair of guide rails attached to the vertical means at an appropriate angle may also be used. Or the pair of guide rails may be replaced by a single guide plate attached to vertical means at an appropriate angle.

The support plate 2 preferably is a mirror plate having a reflecting upper surface 11. A reflecting support plate may be made of a laminate of a plurality of layers as is conventional in the manufacture of mirrors, e.g. transparent material, e.g. comprising an upper layer of transparent material, e.g. a plate of rigid transparent plastic material or glass, a middle layer of reflecting material, e.g. a metal coating, and a lower protective layer, e.g. a film or sheet of a plastic material or a protective paint coating. If desired, an additional base support layer for providing sufficient rigidity to the support plate 2 for supporting the plurality of test tubes 20 may be present. It is apparent that any other reflecting plate, e.g. a reflecting metal plate or a laminate of a reflecting upper layer and a support base layer may also be used.

In case that the primary object is to improve accessibility of test tubes, yet reflection of the test tube bottoms is of no importance, the support plate may be made of any of the materials used for the holding means, e.g. the aperture plates, and for the vertical support means, e.g. the sidewalls.

Whereas an inclination of the support plate at an angle of about 25° away from horizontal is shown in the drawings, it is apparent that this angle may vary. Suitably the angle is in the range of between about 10 and about 35°, in particular, between about 10 and about 30°. Within this range, the choice of an actual angle will depend on the number of test tube rows in a rack, the desired degree of elevation of the rear rows of test tubes relative to the front rows and the desired degree of reflection of the bottom of the test tubes. Usually, an angle of from about 25° to about 30° is convenient.

Preferably, the support plate 2 is releasably connected to the vertical sidewalls, so that it can be easily removed for cleaning and before autoclaving the test tube rack.

Of course, where the support plate can withstand without damage, e.g. to the reflecting layer, the same cleaning and sterilizing procedure as the other elements of the test tube rack, it may also be permanently connected to the sidewalls.

The design of the rack shown in the drawings comprising two rectangular horizontal parallel spaced apart and vertically aligned aperture plates of transparent rigid substantially scratch-resistant material each having a plurality of apertures disposed in a plurality of parallel rows, and a pair of rectangular parallel sidewalls of transparent substantially scratch-resistant material rigidly holding said aperture plates super-imposed in said spaced apart relationship and below said aperture plates a spaced apart rectangular reflecting support mirror plate disposed at an upward angle of about 25° away from horizontal in the direction from front to bottom between said sidewalls and being loosely connected thereto by means of a pair of parallel aligned guide rails of transparent rigid substantially scratch-resistant material each attached to the inner surface of the sidewalls at said angle away from the horizontal and each having an upward projection of its front end, provides for an unique elegant crystal-like appearance of the rack.

What is claimed is:

1. A test tube rack comprising (a) a support plate for supporting a plurality of test tubes at the rear portion of their bottoms which support plate is inclined at an upward angle of from about 10° to about 35° away from the horizontal in the direction from front to rear, and wherein said support plate has a reflecting upper surface; (b) holding means above said support plate for maintaining said test tubes in upright position at a predetermined spaced relationship to each other; (c) vertical means attached to said holding means for supporting said holding means and said support plate in a predetermined spaced relationship to each other; and (d) means for connecting said support plate to said vertical means.

2. The test tube rack as defined in claim 1 wherein the holding means comprises an aperture plate having a plurality of spaced apart apertures for receiving each test tube.

3. The test tube rack as defined in claim 1 wherein the holding means comprises a pair of parallel spaced apart aperture plates each having a plurality of apertures each of said apertures in one plate being vertically aligned with a corresponding aperture in the other plate.

4. The test tube rack as defined in claim 1 wherein the vertical means comprises a pair of parallel vertical sidewalls.

5. The test tube rack as defined in claim 1 wherein the connecting means comprises a pair of parallel guide rails comprising an upward projection at their front end, said guide rails being attached to said vertical means disposed at said angle of from about 10° to about 35° away from horizontal in the direction from front to bottom.

6. The test tube rack as defined in claim 1 wherein the holding means, the vertical means and the connecting means are of a substantially translucent rigid plastic material.

7. The test tube rack as defined in claim 1 wherein the support plate is comprised of laminate comprising a translucent upper layer of substantially rigid transparent plastic material, a middle layer of reflecting material and a lower protective layer.

8. A test tube rack comprising (a) a support plate for supporting a plurality of test tubes at the rear portion of their bottoms which support plate is inclined at an upward angle of from about 10° to about 30° away from the horizontal in the direction from front to rear and has a reflecting upper surface for visualizing the bottoms of said test tubes, (b) holding means above said support plate for maintaining said test tubes in upright position comprising a pair of spaced apart superimposed parallel substantially horizontal aperture plates each plate having a plurality of individual apertures disposed in a plurality of parallel rows each including the same number of apertures each of said apertures in one aperture plate being vertically aligned with a corresponding aperture in the other aperture plate, (c) vertical means for supporting said support plate and said aperture plates in a predetermined spaced relationship to each other comprising a pair of parallel sidewalls attached to said aperture plates and rigidly holding same in said spaced apart position, (d) means for releasably connecting said support plate to said sidewalls comprising a pair of parallel guide rails each engaged in a a shallow elongated groove disposed along the inner surface of one of the sidewalls at said angle of from about 10° to about 30° away from the horizontal in the direction from front to rear each of said guide rails having an upward projection at its front end.

9. The test tube rack of claim 1 wherein the aperatures are of a size to hold test tubes having a diameter of 10–15 millimeters.

* * * * *